US007762857B2

(12) United States Patent
Ngo et al.

(10) Patent No.: US 7,762,857 B2
(45) Date of Patent: Jul. 27, 2010

(54) POWER CONNECTORS WITH CONTACT-RETENTION FEATURES

(75) Inventors: Hung Viet Ngo, Harrisburg, PA (US); Timothy W. Houtz, Etters, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 87 days.

(21) Appl. No.: 12/109,750

(22) Filed: Apr. 25, 2008

(65) Prior Publication Data

US 2009/0088028 A1 Apr. 2, 2009

Related U.S. Application Data

(60) Provisional application No. 60/976,620, filed on Oct. 1, 2007.

(51) Int. Cl.
*H01R 11/22* (2006.01)

(52) U.S. Cl. ..... 439/856; 439/747

(58) Field of Classification Search ..... 439/856, 439/857, 744–748, 871, 872
See application file for complete search history.

(56) References Cited

U.S. PATENT DOCUMENTS

| | | | |
|---|---|---|---|
| 318,186 | A | 5/1885 | Hertzog |
| 741,052 | A | 10/1903 | Mahon |
| 1,477,527 | A | 12/1923 | Raettig |
| 2,248,675 | A | 7/1941 | Huppert |
| 2,430,011 | A | 11/1947 | Gillentine |
| 2,759,163 | A | 8/1956 | Ustin et al. |
| 2,762,022 | A | 9/1956 | Benander et al. |
| 2,844,644 | A | 7/1958 | Soule, Jr. |
| 3,011,143 | A | 11/1961 | Dean |
| 3,178,669 | A | 4/1965 | Roberts |
| 3,208,030 | A | 9/1965 | Evans et al. |
| 3,286,220 | A | 11/1966 | Marley et al. |
| 3,411,127 | A | 11/1968 | Adams |
| 3,420,087 | A | 1/1969 | Hatfield et al. |

(Continued)

FOREIGN PATENT DOCUMENTS

| | | |
|---|---|---|
| DE | 1 665 181 | 4/1974 |

(Continued)

OTHER PUBLICATIONS

Finan, J.M., "Thermally Conductive Thermoplastics", LNP Engineering Plastics, Inc., Plastics Engineering 2000, www.4spe.org, 4 pages.

(Continued)

*Primary Examiner*—Ross N Gushi
(74) *Attorney, Agent, or Firm*—Woodcock Washburn LLP

(57) ABSTRACT

A power receptacle contact may include first and second contact beams that deflect independently of one another during mating of the power receptacle contact with a complementary blade contact. Each beam may extend from abutting respective body portions. The power receptacle contact may include a first clip that extends from the first contact beam. The first clip may define a blade receiving area between the first and second contact beams. A power connector may include a housing and a contact received in the housing. The contact may includes first and second protrusions that prevent the contact from moving in a first direction relative to the housing and in a second direction opposite the first direction.

22 Claims, 11 Drawing Sheets

U.S. PATENT DOCUMENTS

| | | | | |
|---|---|---|---|---|
| 3,514,740 | A | 5/1970 | Filson et al. | |
| 3,538,486 | A | 11/1970 | Shlesinger, Jr. | |
| 3,634,811 | A | 1/1972 | Teagno | |
| 3,669,054 | A | 6/1972 | Desso et al. | |
| 3,692,994 | A | 9/1972 | Hirschmann et al. | |
| 3,748,633 | A | 7/1973 | Lundergan | |
| 3,845,451 | A | 10/1974 | Neidecker | |
| 3,871,015 | A | 3/1975 | Lin et al. | |
| 3,942,856 | A | 3/1976 | Mindheim et al. | |
| 3,972,580 | A | 8/1976 | Pemberton et al. | |
| 4,070,088 | A | 1/1978 | Vaden | |
| 4,076,362 | A | 2/1978 | Ichimura | |
| 4,082,407 | A | 4/1978 | Smorzaniuk et al. | |
| 4,136,919 | A | 1/1979 | Howard et al. | |
| 4,159,861 | A | 7/1979 | Anhalt | |
| 4,217,024 | A | 8/1980 | Aldridge et al. | |
| 4,260,212 | A | 4/1981 | Ritchie et al. | |
| 4,288,139 | A | 9/1981 | Cobaugh et al. | |
| 4,371,912 | A | 2/1983 | Guzik | |
| 4,383,724 | A | 5/1983 | Verhoevan | |
| 4,402,563 | A | 9/1983 | Sinclair | |
| 4,403,821 | A | 9/1983 | Zimmerman et al. | |
| 4,473,113 | A | 9/1984 | Whitfield et al. | |
| 4,505,529 | A | 3/1985 | Barkus | |
| 4,533,187 | A | 8/1985 | Kirkman | |
| 4,536,955 | A | 8/1985 | Gudgeon | |
| 4,545,610 | A | 10/1985 | Lakritz et al. | |
| 4,552,425 | A | 11/1985 | Billman | |
| 4,560,222 | A | 12/1985 | Dambach | |
| 4,564,259 | A | 1/1986 | Vandame | |
| 4,596,433 | A | 6/1986 | Oesterheld et al. | |
| 4,685,886 | A | 8/1987 | Denlinger et al. | |
| 4,717,360 | A | 1/1988 | Czaja | |
| 4,767,344 | A | 8/1988 | Noschese | |
| 4,776,803 | A | 10/1988 | Pretchel et al. | |
| 4,782,893 | A | 11/1988 | Thomas | |
| 4,790,763 | A | 12/1988 | Weber et al. | |
| 4,815,987 | A | 3/1989 | Kawano et al. | |
| 4,818,237 | A | 4/1989 | Weber | |
| 4,820,169 | A | 4/1989 | Weber et al. | |
| 4,820,182 | A | 4/1989 | Harwath et al. | |
| 4,867,713 | A | 9/1989 | Ozu et al. | |
| 4,878,611 | A | 11/1989 | LoVasco et al. | |
| 4,881,905 | A | 11/1989 | Demler, Jr. et al. | |
| 4,900,271 | A | 2/1990 | Colleran et al. | |
| 4,907,990 | A | 3/1990 | Bertho et al. | |
| 4,915,641 | A | 4/1990 | Miskin et al. | 439/247 |
| 4,963,102 | A | 10/1990 | Gettig et al. | |
| 4,965,699 | A | 10/1990 | Jorden et al. | |
| 4,973,257 | A | 11/1990 | Lhotak | |
| 4,973,271 | A | 11/1990 | Ishizuka et al. | |
| 4,974,119 | A | 11/1990 | Martin | |
| 4,975,084 | A | 12/1990 | Fedder et al. | |
| 4,979,074 | A | 12/1990 | Morley | |
| 5,016,968 | A | 5/1991 | Hammond et al. | 350/96.2 |
| 5,024,610 | A | 6/1991 | French et al. | |
| 5,035,639 | A | 7/1991 | Kilpatrick et al. | |
| 5,046,960 | A | 9/1991 | Fedder et al. | |
| 5,052,953 | A | 10/1991 | Weber | |
| 5,066,236 | A | 11/1991 | Broeksteeg | |
| 5,077,893 | A | 1/1992 | Mosquera et al. | |
| 5,082,459 | A | 1/1992 | Billman et al. | |
| 5,094,634 | A | 3/1992 | Dixon et al. | |
| 5,104,332 | A | 4/1992 | McCoy | |
| 5,137,959 | A | 8/1992 | Block et al. | |
| 5,139,426 | A | 8/1992 | Barkus et al. | |
| 5,151,056 | A | 9/1992 | McClune | |
| 5,152,700 | A | 10/1992 | Bogursky et al. | |
| 5,174,770 | A | 12/1992 | Sasaki et al. | |
| 5,194,480 | A | 3/1993 | Block et al. | |
| 5,213,868 | A | 5/1993 | Liberty et al. | |
| 5,214,308 | A | 5/1993 | Nishiguchi | |
| 5,238,414 | A | 8/1993 | Yaegashi et al. | |
| 5,254,012 | A | 10/1993 | Wang | |
| 5,274,918 | A | 1/1994 | Reed | |
| 5,276,964 | A | 1/1994 | Anderson, Jr. et al. | |
| 5,286,212 | A | 2/1994 | Broeksteeg | |
| 5,295,843 | A | 3/1994 | Davis et al. | 439/108 |
| 5,298,791 | A | 3/1994 | Liberty et al. | |
| 5,302,135 | A | 4/1994 | Lee | |
| 5,321,582 | A | 6/1994 | Casperson | |
| 5,381,314 | A | 1/1995 | Rudy, Jr. et al. | |
| 5,400,949 | A | 3/1995 | Hirvonen et al. | |
| 5,427,543 | A | 6/1995 | Dynia | |
| 5,431,578 | A | 7/1995 | Wayne | |
| 5,457,342 | A | 10/1995 | Herbst, II | |
| 5,458,426 | A | 10/1995 | Ito | |
| 5,475,922 | A | 12/1995 | Tamura et al. | |
| 5,490,040 | A | 2/1996 | Gavdenzi et al. | |
| 5,511,987 | A | 4/1996 | Shinchi | |
| 5,512,519 | A | 4/1996 | Hwang | |
| 5,533,915 | A | 7/1996 | Deans | |
| 5,558,542 | A | 9/1996 | O'Sullivan et al. | |
| 5,564,952 | A | 10/1996 | Davis et al. | |
| 5,577,928 | A | 11/1996 | Duclos | |
| 5,582,519 | A | 12/1996 | Buchter | |
| 5,588,859 | A | 12/1996 | Maurice | |
| 5,590,463 | A | 1/1997 | Feldman et al. | |
| 5,609,502 | A | 3/1997 | Thumma | |
| 5,618,187 | A | 4/1997 | Goto | |
| 5,637,008 | A | 6/1997 | Kozel | |
| 5,643,009 | A | 7/1997 | Dinkel et al. | |
| 5,664,968 | A | 9/1997 | Micklevicz | |
| 5,664,969 | A | 9/1997 | Peterson | |
| 5,664,973 | A | 9/1997 | Emmert et al. | |
| 5,667,392 | A | 9/1997 | Kocher et al. | |
| 5,691,041 | A | 11/1997 | Frankeny et al. | |
| 5,702,255 | A | 12/1997 | Murphy et al. | |
| 5,727,963 | A | 3/1998 | LeMaster | |
| 5,730,609 | A | 3/1998 | Harwath | |
| 5,741,144 | A | 4/1998 | Elco et al. | |
| 5,741,161 | A | 4/1998 | Cahaly et al. | |
| 5,742,484 | A | 4/1998 | Gillette et al. | |
| 5,743,009 | A | 4/1998 | Matsui et al. | |
| 5,745,349 | A | 4/1998 | Lemke | |
| 5,746,608 | A | 5/1998 | Taylor | |
| 5,749,746 | A | 5/1998 | Tan et al. | |
| 5,755,595 | A | 5/1998 | Davis et al. | |
| 5,772,451 | A | 6/1998 | Dozier, II et al. | |
| 5,782,644 | A | 7/1998 | Kiat | |
| 5,787,971 | A | 8/1998 | Dodson | |
| 5,795,191 | A | 8/1998 | Preputnick et al. | |
| 5,810,607 | A | 9/1998 | Shih et al. | |
| 5,817,973 | A | 10/1998 | Elco et al. | |
| 5,827,094 | A | 10/1998 | Aizawa et al. | |
| 5,831,314 | A | 11/1998 | Wen | |
| 5,857,857 | A | 1/1999 | Fukuda | |
| 5,874,776 | A | 2/1999 | Kresge et al. | |
| 5,876,219 | A | 3/1999 | Taylor et al. | |
| 5,876,248 | A | 3/1999 | Brunker | |
| 5,882,214 | A | 3/1999 | Hillbish et al. | |
| 5,883,782 | A | 3/1999 | Thurston et al. | |
| 5,888,884 | A | 3/1999 | Wojnarowski | |
| 5,908,333 | A | 6/1999 | Perino et al. | |
| 5,919,050 | A | 7/1999 | Kehley et al. | |
| 5,930,114 | A | 7/1999 | Kuzmin et al. | |
| 5,955,888 | A | 9/1999 | Frederickson et al. | |
| 5,961,355 | A | 10/1999 | Morlion et al. | |
| 5,971,817 | A | 10/1999 | Longueville | |
| 5,975,921 | A | 11/1999 | Shuey | |
| 5,980,270 | A | 11/1999 | Fjelstad et al. | |
| 5,980,321 | A | 11/1999 | Cohen et al. | |
| 5,984,726 | A | 11/1999 | Wu | |
| 5,993,259 | A | 11/1999 | Stokoe et al. | |

6,012,948 A 1/2000 Wu
6,036,549 A 3/2000 Wulff
6,041,498 A 3/2000 Hillbish et al.
6,050,862 A 4/2000 Ishii
6,059,170 A 5/2000 Jimarez et al.
6,066,048 A 5/2000 Lees
6,068,520 A 5/2000 Winings et al.
6,071,152 A 6/2000 Achammer et al.
6,077,130 A 6/2000 Hughes et al.
6,089,878 A 7/2000 Meng
6,095,827 A 8/2000 Dutkowsky et al.
6,123,554 A 9/2000 Ortega et al.
6,125,535 A 10/2000 Chiou et al.
6,139,336 A 10/2000 Olson
6,146,157 A 11/2000 Lenoir et al.
6,146,202 A 11/2000 Ramey et al.
6,146,203 A 11/2000 Elco et al.
6,152,756 A 11/2000 Huang et al.
6,174,198 B1 1/2001 Wu et al.
6,180,891 B1 1/2001 Murdeshwar
6,183,287 B1 2/2001 Po
6,183,301 B1 2/2001 Paagman
6,190,213 B1 2/2001 Reichart et al.
6,193,537 B1 2/2001 Harper, Jr. et al.
6,196,871 B1 3/2001 Szu
6,202,916 B1 3/2001 Updike et al.
6,206,722 B1 3/2001 Ko et al.
6,210,197 B1 4/2001 Yu
6,210,240 B1 * 4/2001 Comerci et al. ..... 439/853
6,212,755 B1 4/2001 Shimada et al.
6,215,180 B1 4/2001 Chen et al.
6,219,913 B1 4/2001 Uchiyama
6,220,884 B1 4/2001 Lin
6,220,895 B1 4/2001 Lin
6,220,896 B1 4/2001 Bertoncici et al.
6,234,851 B1 5/2001 Phillips
6,238,225 B1 5/2001 Middlehurst et al.
6,257,478 B1 7/2001 Straub
6,259,039 B1 7/2001 Chroneos, Jr. et al.
6,261,132 B1 7/2001 Koseki et al.
6,269,539 B1 8/2001 Takahashi et al.
6,274,474 B1 8/2001 Caletka
6,280,230 B1 8/2001 Takase et al.
6,293,827 B1 9/2001 Stokoe et al.
6,299,492 B1 10/2001 Pierini et al.
6,309,245 B1 10/2001 Sweeney
6,319,075 B1 11/2001 Clark et al.
6,322,377 B2 11/2001 Middlehurst et al.
6,328,602 B1 12/2001 Yamasaki et al.
6,347,952 B1 2/2002 Hasegawa et al.
6,350,134 B1 2/2002 Fogg et al.
6,359,783 B1 3/2002 Noble
6,360,940 B1 3/2002 Bolde et al.
6,362,961 B1 3/2002 Chiou
6,363,607 B1 4/2002 Chen et al.
6,371,773 B1 4/2002 Crofoot et al.
6,379,188 B1 4/2002 Cohen et al.
6,386,924 B2 5/2002 Long
6,394,818 B1 5/2002 Smalley, Jr.
6,402,566 B1 6/2002 Middlehurst et al. ..... 439/699.1
6,409,543 B1 6/2002 Astbury, Jr. et al.
6,428,328 B2 8/2002 Haba et al.
6,431,914 B1 8/2002 Billman
6,435,914 B1 8/2002 Billman
6,450,829 B1 9/2002 Weisz-Margulescu
6,461,183 B1 10/2002 Ohkita et al.
6,461,202 B2 10/2002 Kline
6,471,523 B1 10/2002 Shuey
6,471,548 B2 10/2002 Bertoncini et al.
6,472,474 B2 10/2002 Burkhardt et al.
6,488,549 B1 12/2002 Weller et al. ..... 439/856
6,489,567 B2 12/2002 Zachrai
6,506,081 B2 1/2003 Blanchfield et al.
6,514,103 B2 2/2003 Pape et al.
6,537,111 B2 3/2003 Brammer et al.
6,544,046 B1 4/2003 Hahn et al.
6,551,112 B1 4/2003 Li et al.
6,554,647 B1 4/2003 Cohen et al.
6,572,410 B1 6/2003 Volstorf et al.
6,575,774 B2 6/2003 Ling et al.
6,575,776 B1 6/2003 Conner et al.
6,592,381 B2 7/2003 Cohen et al.
6,604,967 B2 8/2003 Middlehurst et al. ..... 439/862
6,629,854 B2 10/2003 Murakami
6,652,318 B1 11/2003 Winings et al.
6,663,426 B2 12/2003 Hasirocoglu et al.
6,665,189 B1 12/2003 Lebo
6,669,514 B2 12/2003 Wiebking et al.
6,672,884 B1 1/2004 Toh et al. ..... 439/79
6,672,907 B2 1/2004 Azuma
6,679,709 B2 1/2004 Takeuchi
6,692,272 B2 2/2004 Lemke et al.
6,702,594 B2 3/2004 Lee et al.
6,705,902 B1 3/2004 Yi et al.
6,712,621 B2 3/2004 Li et al.
6,716,068 B2 4/2004 Wu
6,740,820 B2 5/2004 Cheng
6,743,037 B2 6/2004 Kassa et al.
6,746,278 B2 6/2004 Nelson et al.
6,769,883 B2 8/2004 Brid et al.
6,769,935 B2 8/2004 Stokoe et al.
6,776,635 B2 8/2004 Blanchfield et al.
6,776,649 B2 8/2004 Pape et al.
6,780,027 B2 8/2004 Allison ..... 439/79
6,790,088 B2 9/2004 Ono et al.
6,796,831 B1 9/2004 Yasufuku et al.
6,810,783 B1 11/2004 Larose
6,811,440 B1 11/2004 Rothermel et al.
6,814,590 B2 11/2004 Minich et al.
6,829,143 B2 12/2004 Russell et al.
6,835,103 B2 12/2004 Middlehurst et al.
6,840,783 B2 1/2005 Wolford et al. ..... 439/110
6,843,687 B2 1/2005 McGowan et al.
6,848,886 B2 2/2005 Schmaling et al.
6,848,950 B2 2/2005 Allison et al.
6,848,953 B2 2/2005 Schell et al.
6,869,294 B2 3/2005 Clark et al.
6,884,117 B2 4/2005 Korsunsky et al.
6,890,221 B2 5/2005 Wagner
6,905,367 B2 6/2005 Crane, Jr. et al.
6,929,504 B2 8/2005 Ling et al.
6,947,012 B2 9/2005 Aisenbrey
6,975,511 B1 12/2005 Lebo et al.
6,994,569 B2 2/2006 Minich et al.
7,001,189 B1 2/2006 McGowan et al.
7,059,892 B1 6/2006 Trout ..... 439/465
7,059,919 B2 6/2006 Clark et al. ..... 439/825
7,065,871 B2 6/2006 Minich et al. ..... 29/882
7,070,464 B2 7/2006 Clark et al.
7,074,096 B2 7/2006 Copper et al.
7,097,465 B1 8/2006 Korsunsky et al.
7,101,228 B2 9/2006 Hamner et al.
7,104,812 B1 9/2006 Bogiel et al.
7,114,963 B2 10/2006 Shuey et al.
RE39,380 E 11/2006 Davis ..... 439/660
7,137,848 B1 11/2006 Trout et al. ..... 439/465
7,168,963 B2 1/2007 Minich et al.
7,182,642 B2 2/2007 Ngo et al.
7,204,699 B2 4/2007 Stoner ..... 439/71
D542,736 S 5/2007 Riku
7,220,141 B2 5/2007 Daily et al.
7,258,562 B2 8/2007 Daily et al. ..... 439/290
7,273,382 B2 9/2007 Igarashi et al.
7,303,427 B2 12/2007 Swain
7,335,043 B2 2/2008 Ngo et al.
7,384,289 B2 6/2008 Minich

| | | | | |
|---|---|---|---|---|
| 7,425,145 | B2 | 9/2008 | Ngo | |
| 7,458,839 | B2 | 12/2008 | Ngo et al. | |
| 7,476,108 | B2 | 1/2009 | Swain et al. | |
| 2001/0003685 | A1 | 6/2001 | Aritani | |
| 2002/0106930 | A1 | 8/2002 | Pape et al. | |
| 2002/0142676 | A1 | 10/2002 | Hosaka et al. | |
| 2002/0159235 | A1 | 10/2002 | Miller et al. | |
| 2002/0193019 | A1 | 12/2002 | Blanchfield et al. | |
| 2003/0013330 | A1 | 1/2003 | Takeuchi | |
| 2003/0119378 | A1 | 6/2003 | Avery | |
| 2003/0143894 | A1 | 7/2003 | Kline et al. | |
| 2003/0219999 | A1 | 11/2003 | Minich et al. | |
| 2003/0220021 | A1 | 11/2003 | Whiteman, Jr. et al. | |
| 2003/0236035 | A1 | 12/2003 | Kuroda et al. | |
| 2004/0147177 | A1 | 7/2004 | Wagner | |
| 2004/0183094 | A1 | 9/2004 | Caletka et al. | |
| 2005/0112952 | A1 | 5/2005 | Wang et al. | |
| 2006/0003620 | A1 | 1/2006 | Daily et al. | |
| 2006/0128197 | A1 | 6/2006 | McGowan et al. | |
| 2006/0228927 | A1 | 10/2006 | Daily | 439/290 |
| 2006/0228948 | A1 | 10/2006 | Swain | 439/660 |
| 2006/0281354 | A1 | 12/2006 | Ngo et al. | |
| 2007/0197063 | A1 | 8/2007 | Ngo | 439/108 |
| 2007/0202748 | A1 | 8/2007 | Daily | 439/608 |
| 2007/0275586 | A1 | 11/2007 | Ngo | 439/290 |
| 2007/0293084 | A1 | 12/2007 | Ngo | 439/552 |
| 2008/0038956 | A1 | 2/2008 | Swain | 439/487 |
| 2008/0248670 | A1 | 10/2008 | Daily et al. | |

FOREIGN PATENT DOCUMENTS

| | | | |
|---|---|---|---|
| DE | 102 26 279 | C1 | 11/2003 |
| EP | 0 273 683 | A2 | 7/1988 |
| EP | 0 321 257 | B1 | 4/1993 |
| EP | 0 623 248 | B1 | 11/1995 |
| EP | 0 789 422 | A2 | 8/1997 |
| GB | 1 162 705 | | 8/1969 |
| JP | 05344728 | | 12/1993 |
| JP | 06-236788 | | 8/1994 |
| JP | 06068943 | | 11/1994 |
| JP | 07-114958 | | 5/1995 |
| JP | 07-169523 | | 7/1995 |
| JP | 08-096918 | | 4/1996 |
| JP | 0 812 5379 | | 5/1996 |
| JP | 08-125379 | | 5/1996 |
| JP | 09-199215 | | 7/1997 |
| JP | 2000-003743 | | 1/2000 |
| JP | 2000-003744 | | 1/2000 |
| JP | 2000-003745 | | 1/2000 |
| JP | 2000-003746 | | 1/2000 |
| JP | 2000-228243 | | 5/2000 |
| JP | 13-135388 | | 5/2001 |
| JP | 2003-217785 | | 7/2003 |
| KR | 100517651 | B1 | 9/2005 |
| TW | 576555 | | 8/1990 |
| TW | 546872 | | 8/2003 |
| WO | WO 97/43885 | | 11/1997 |
| WO | WO 97/44859 | | 11/1997 |
| WO | WO 98/15989 | | 4/1998 |
| WO | WO 00/16445 | | 3/2000 |
| WO | WO 01/29931 | A1 | 4/2001 |
| WO | WO 01/39332 | A1 | 5/2001 |
| WO | WO 02/103847 | | 12/2002 |
| WO | WO 2005/065254 | | 7/2005 |
| WO | WO 2007/064632 | | 6/2007 |
| WO | WO 2008/117180 | | 10/2008 |

OTHER PUBLICATIONS

Sherman, L.M., "Plastics that Conduct Heat", Plastics Technology Online, Jun. 2001, http://www.plasticstechnology.com, 4 pages.

Ogando, J., "And now-An Injection-Molded Heat Exchanger", Sure, plastics are thermal insulators, but additive packages allow them to conduct heat instead, Global Design News, Nov. 1, 2000, 4 pages.

Power Connectors & Interconnection Systems, Tyco Electronics, Introduction to High Current Card Edge Connectors, Revised Jul. 2007, 137-155.

U.S. Appl. No. 12/317,366, filed Dec. 22, 2008, Minich.

Metral 1000 Series, PCB Mounted Receptacle Assembly, FCI Web Site page, 2001, 1 p.

Power TwinBlade™ I/O Cable Connector RA-North-South, No. GS-20_072, Aug. 6, 2007, 11 pages.

Product Datasheets, 10 Bgit/s XENPAK 850 nm Transponder (TRP10GVP2045), Copyright 2005, MergeOptics GmbH, 13 pages.

Product Datasheets, Welome to XENPAK.org., Copyright 2001, http://www.xenpak.org., 1 page.

U.S. Appl. No. 12/054,023, filed Mar. 24, 2008, Stoner, S.

U.S. Appl. No. 11/751,351, filed May 21, 2007, Ngo, H.

* cited by examiner

POWER CONNECTORS WITH CONTACT-RETENTION FEATURES

CROSS REFERENCE TO RELATED APPLICATIONS

This application claims the benefit of U.S. Provisional Application No. 60/976,620 filed Oct. 1, 2007.

BACKGROUND

Connectors used to transmit electrical power, such as alternating current (AC) power and/or direct current (DC) power, may include a power contact mounted within an electrically-insulative housing. In a typical application, the connector may be mounted to a substrate, such as a circuit board, and the connector may be may be configured to mate with a corresponding power cable assembly. Specifically, each power contact within the housing may include one or more male contact beams and/or female receptacles that mate with that of the opposite gender within the power cable assembly.

When mating and un-mating the cable assembly with the mounted connector, substantial forces may be exerted on the individual power contacts within the cable assembly and within the mounted connector. These forces may dislodge the power contacts from their position in the housing and/or power cable if they are not sufficiently retained.

The capacity and efficiency of power transmission through power contacts may be affected by the contact's shape, size, material, internal resistance, extent of physical contact with the mating contact, etc. A contact's power transmission performance may relate to the quality and extent of physical contact between complementary contacts. Deformation of power contacts (e.g., by the forces of mating and unmating the connector) that affect the quality and extent of physical contact may affect the contact's power transmission performance. Traditionally, improving a contact's power transmission capacity and physical contact stability has been met with increasingly larger, heavier connectors. Increases in size and conductive materials often drive increases in manufacturing costs.

SUMMARY

The disclosed electrical connectors and contacts employ a novel structure for improved performance in power capacity and physical contact stability and still allowing for lower manufacturing costs. For example, the electrical contacts may be stamped-metal contacts that include first and second contact beams that deflect independently of one another during mating of the power receptacle contact with a complementary blade contact. Each beam may extend from abutting respective body portions. The power receptacle contact may include a first clip that extends from the first contact beam. The first clip may define a blade receiving area between the first and second contact beams. An edge of the first clip may abut the second contact beam. The edge of the first clip may overlap the second contact beam. The power receptacle contact may include a second clip that extends from the second contact beam. The second clip may define a blade receiving area between the first and second contact beams. The contact beams may each be part of respective contact halves that are substantially identical.

The contacts may include various retention features to provide stability when mating and un-mating. For example, a power connector may include a housing and a contact received in the housing. The contact may include a body portion and a contact beam that extends from the body portion. The body portion may be a planar body portion. The contact beam may extend from the body portion in a first direction.

The contact may include first and second protrusions. The first protrusion may prevent the contact from moving in the first direction relative to the housing. For example, the first protrusion may include a latch that extends from the contact body and engages the housing.

The second protrusion may prevent the contact from moving in a second direction relative to the housing. The second direction may be opposite the first direction. The second protrusion may include a tab that extends from the planar body portion and engages the housing.

The contact may include a plurality of fingers that extend from the body portion in the second direction. The tab may prevent the fingers from spreading when a force in the second direction is applied to the contact portion.

DETAILED DESCRIPTION

Certain terminology may be used in the following description for convenience only and should not be considered as limiting in any way. For example, the terms "top," "bottom," "left," "right," "upper," and "lower" designate directions in the figures to which reference is made. Likewise, the terms "inwardly," "outwardly," "upwardly," and "downwardly" may designate directions toward and away from, respectively, the geometric center of the referenced object. The terminology includes the words above specifically mentioned, derivatives thereof, and words of similar import.

Figure 1:
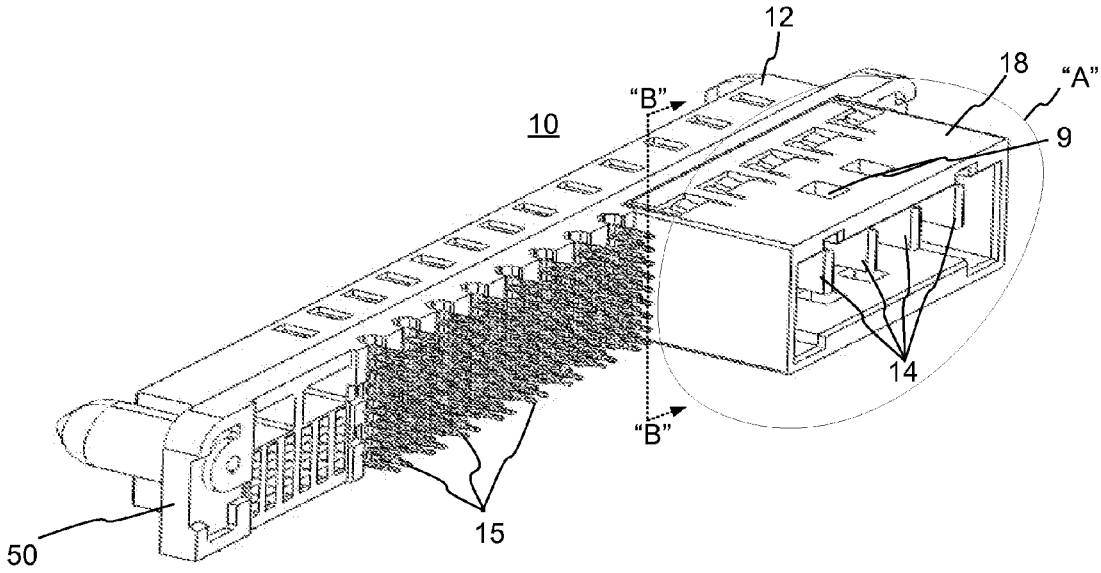
FIGS. 1 and 2 depict an example electrical connector in top rear perspective view with and without a shroud, respectively.
Figure 2:
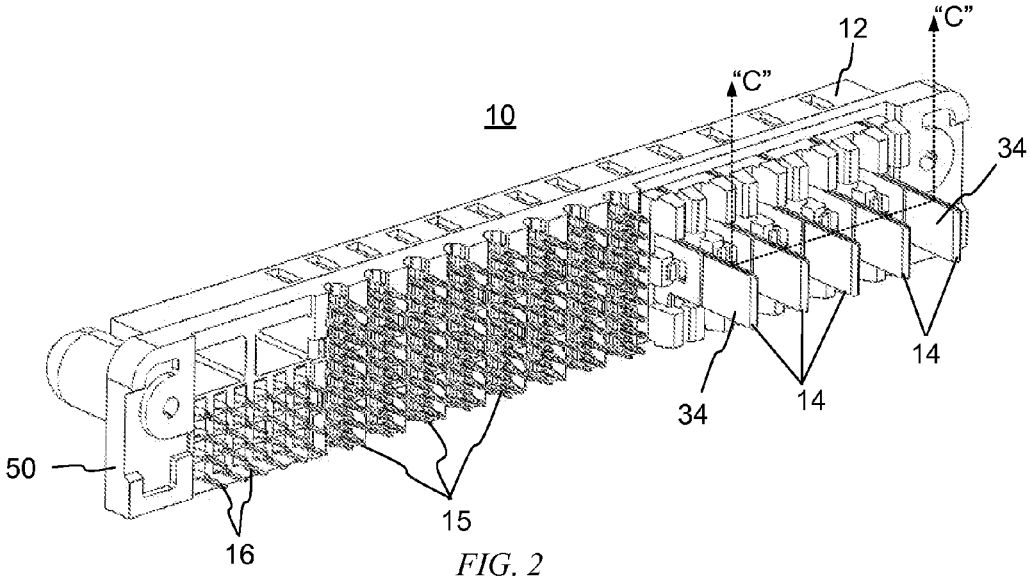

FIGS. 1 and 2 depict a top rear perspective view of connector 10, illustrated with a shroud 18 and without the shroud 18 respectively. The electrical connector 10 may provide electrical connectivity for data transmission signals and for power (i.e., alternating current (AC) power and direct current (DC) power).

The electrical connector 10 may include a housing 12, a power contact 14 for AC power, a power contact 15 for DC power, a signal contact 16 (shown in FIG. 2), and/or a shroud 18. The housing 12 may be an electrically-insulative housing. When the shroud 18 is retained to the housing 12, the shroud 18 may cover the power contacts 14.

The power contacts 14, 15 and signal contacts 16 may be mounted within the housing 12. As shown, connector 10 is depicted with five of the power contacts 14. The electrical connector 10 may include more or less than five of the power contacts 14 shown. Similarly, alternative embodiments can be configured with more or less than the number of power contacts 15 and signal contacts 16 than what is depicted.

The electrical connector 10 may be used in any application for which electrical conductivity between components is desired. For example, the electrical connector 10 may enable electrical conductivity between the power contacts 14 and a power cable assembly (not shown). The electrical connector 10 may enable electrical conductivity between the power contacts 14 and a complementary electrical connector (not shown). The electrical connector 10 may enable electrical conductivity between the power contacts 14 and a conductive trace on a substrate (not shown) to which the electrical connector 10 is mounted.

Figure 3:
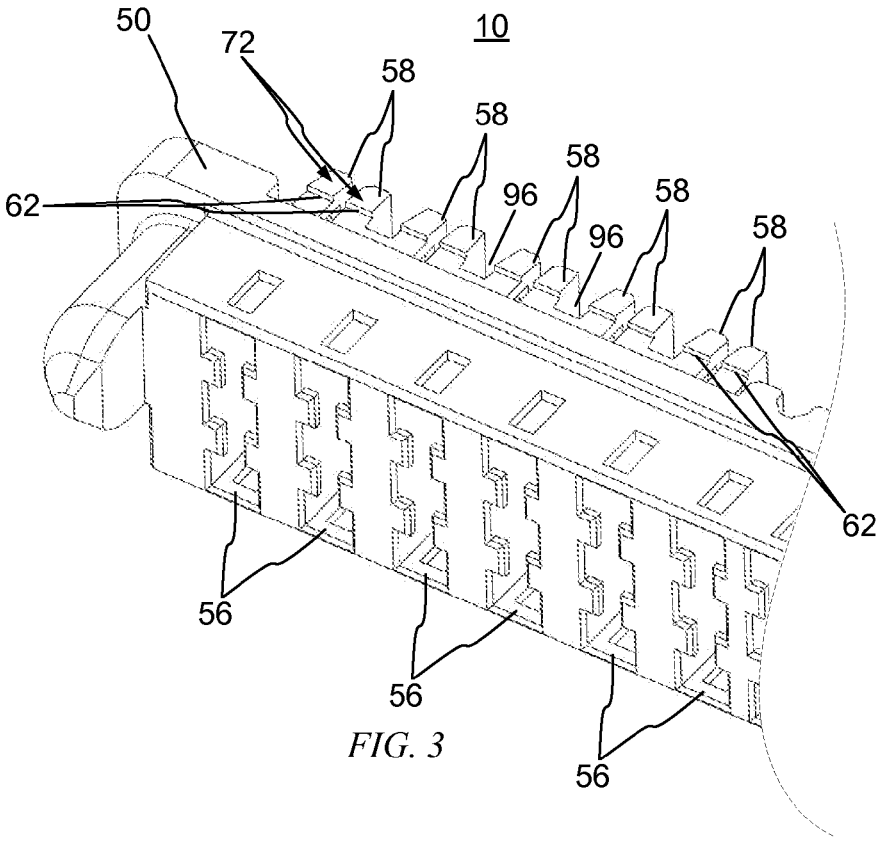
FIGS. 3 and 4 depict the area designated "A" in FIG. 1, without the shroud, and power contacts in top front perspective view and bottom rear perspective view, respectively.
Figure 4:
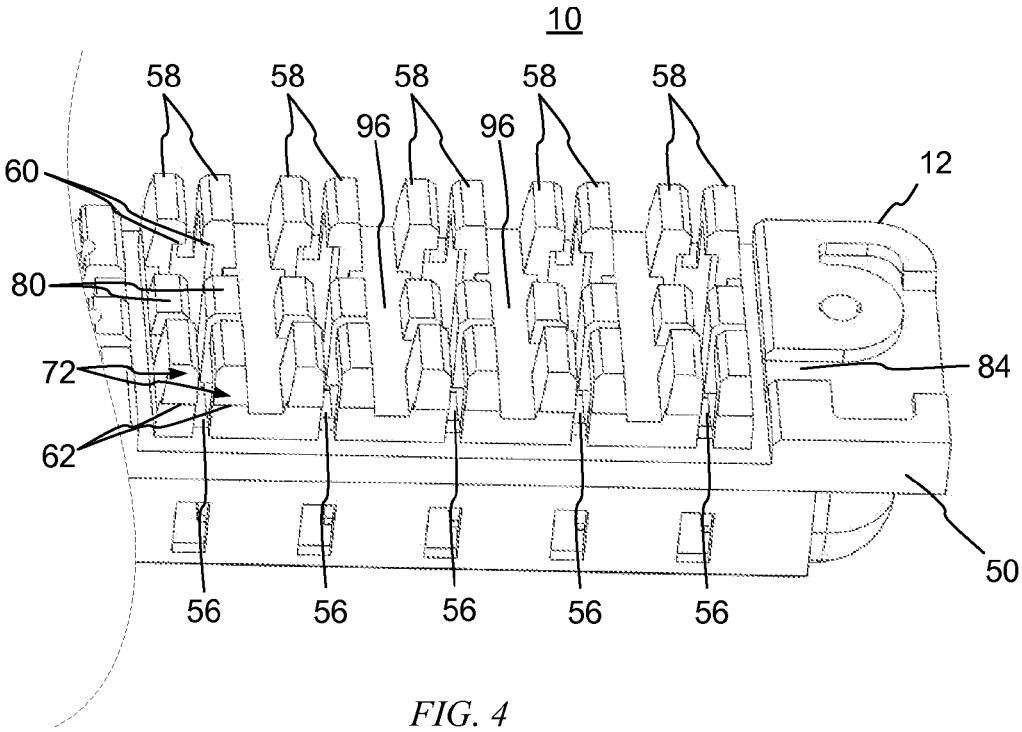

FIGS. 3-4 depict the area designated "A" in FIG. 1, without the shroud 18 and power contacts 14, in a top front perspective view and bottom rear perspective view, respectively. The housing 12 may define a middle portion 50. Adjacent columns of projections 58 may extend from the middle portion 50. Each projection 58 may define a respective horizontally-oriented lip 62 at the edge of an upwardly or downwardly-facing angled surface 72. The adjacent columns of projections 58 may define pockets 96 between the columns. The horizontally-oriented lips 62 and pockets 96 may be used to retain the shroud 18 to the connector housing 12.

The housing 12 may include one or more passages 56. The power contacts 14 may be retained within the passages. The passages 56 may extend through the housing 12 to enable connector mating on both sides of the housing 12.

Figure 5:
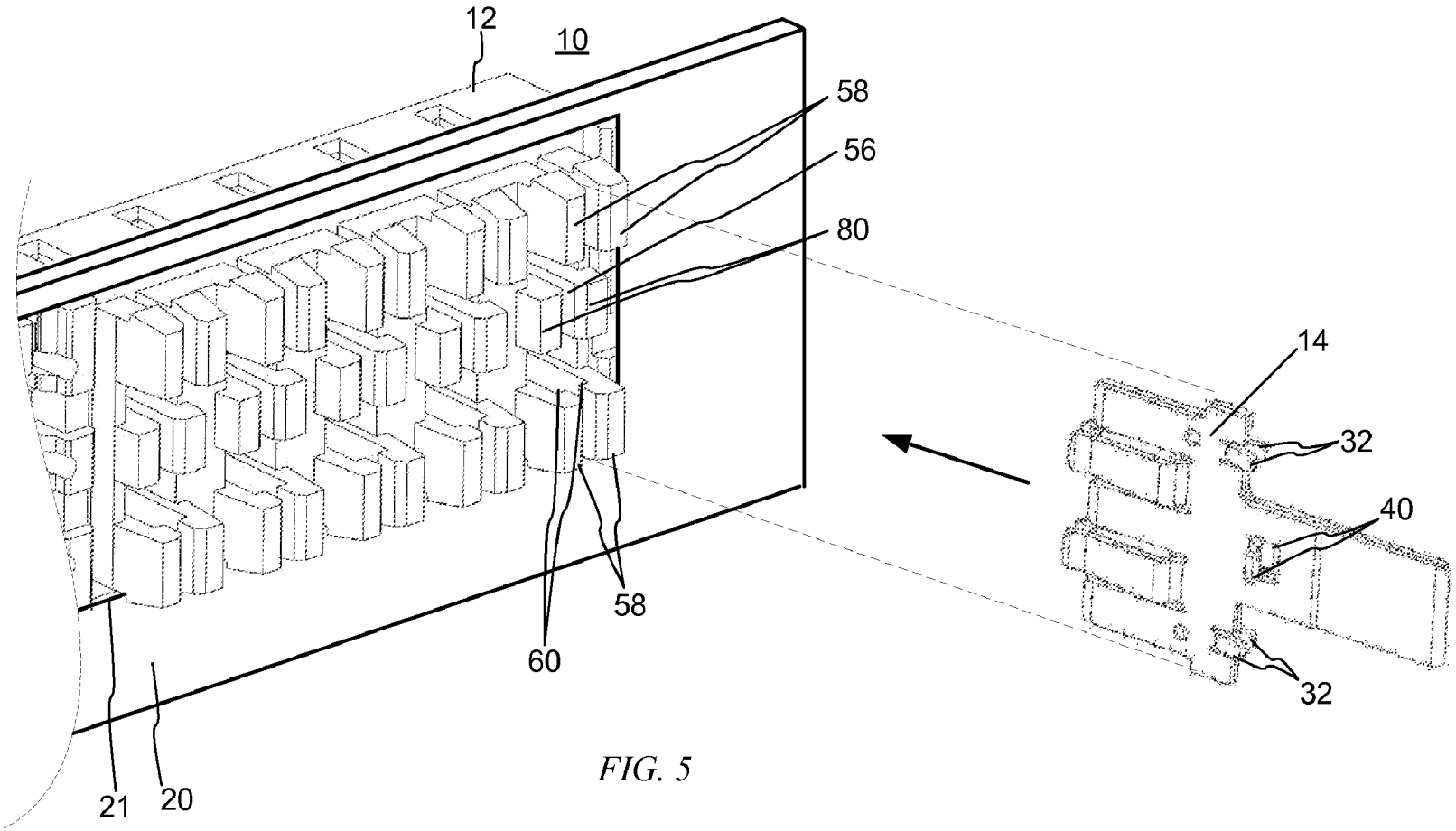
FIG. 5 depicts the area designated "A" in FIG. 1, without the shroud, and power contacts in top rear perspective view and illustrates the electrical connector mounted on a substrate and receiving an example power contact.

FIG. 5 depicts the area designated "A" in FIG. 1, without the shroud 18 and power contacts 14 in top rear perspective view and illustrates the electrical connector 10 mounted on a substrate 20 and receiving an example power contact 14. The connector 10 may be mounted on a substrate 20 such as a printed circuit board. The substrate 20 may include a cutout window 21 that permits the power contacts 14, 15 and the signal contacts 16 to pass through the substrate 20.

The housing 12 may include a retention feature to secure one or more power contacts 14. The projections 58 may help retain the power contacts 14 in the housing 12. In particular, the projections 58 each include a vertically-oriented lip 60 and a stop 80. Adjacent projections 58 may define a passage 56. The connector 10 may include one or more passages 56.

The power contact 14 may be received by the passage 56 as depicted in FIG. 5. Once the power contact 14 is inserted, the housing 12 in cooperation with the power contact 14 may secure the contact 14 within the passage 56. For example, the contact 14 may define one or more protrusions, such as latches 32 and tabs 40. The protrusions, in combination with features of the housing 12 may secure the power contact 14 within the passage 56. For example, the tab 40 may engage the stop 80 to prevent the contact 14 from moving further into the housing 12. For example, the latches 32 may engage the vertically-oriented lip 60 to prevent the contact 14 from moving back out of the housing 12, in a direction opposite the direction in which it was inserted.

FIGS. 6-10B depict various example power contacts. The example power contacts may be manufactured using a common die with interchangeable tooling. For example, the power contacts may be manufactured as a stamped-metal contacts.

Figure 6:
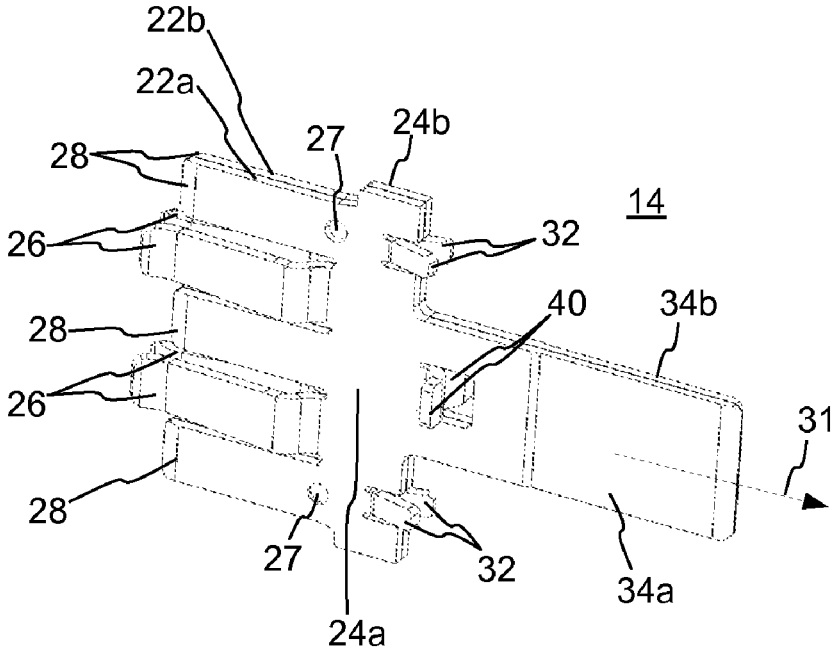
FIGS. 6-10B depict example power contacts, in top rear perspective view.

As depicted in FIG. 6, the power contact 14 may include a first half 22*a* and a substantially identical second half 22*b*. The first and second halves 22*a*, 22*b* may each include a body portion 24*a*, 24*b*. The body portions 24*a*, 24*b* may abut one another. The body portions 24*a*, 24*b* may be planar body portions. The first and second halves 22*a*, 22*b* may also include fingers extending from the body portion 24*a*, 24*b*. The fingers may include angled contact beams 26, and substantially straight contact beams 28. The angled contact beams 26 and the straight contact beams 28 may adjoin the body portion 24*a*, 24*b* of the corresponding first or second half 22*a*, 22*b*. The angled contact beams 26 and the straight contact beams 28 may be arranged on the body portions 24*a*, 24*b* in an alternating and/or staggered manner. The first half 22*a* may be stacked against a corresponding second half 22*b*, so that each angled contact beam 26 of the first half 22*a* faces a corresponding angled contact beam 26 of the second half 22*b* and each straight contact beam 28 of the first half 22*a* faces a corresponding straight contact beam 28 of the second half 22*b*.

The first and second halves 22*a*, 22*b* may each be configured with an alignment feature such as a projection 27. The projection 27 of each of the first and second halves 22*a*, 22*b* may be received in a corresponding through-hole formed in the other of the first or second halves 22*a*, 22*b*. Interference between the projection 27 and the peripheral surfaces of the corresponding through holes may maintain the first and second halves 22*a*, 22*b* in a state of alignment when, for example, the power contact 14 is inserted into the housing 12.

Contact beams 34*a*, 34*b* may each extend from respective first and second body portions 24*a*, 24*b*. A first contact beam 34*a* may extend from the first body portion 24*a* in a first direction 31. A second contact beam 34*b* may extend from the second body portion 24*b* in the first direction 31. Thus, each of the first and second halves 22*a*, 22*b* may each include a respective contact beam 34*a*, 34*b* that extends from the respective body portion 24*a*, 24*b*.

The contact beams 34*a*, 34*b* may be substantially flat. The contact beams 34*a*, 34*b* of each corresponding first half and second half 22*a*, 22*b* may face and abut each other. As shown in FIG. 6, the contact beams 34*a*, 34*b* may each be a male contact beam in the form of a contact blade. For example, the beams 34*a*, 34*b* may be faston blades. Other types of blades may be used as well.

Figure 15:
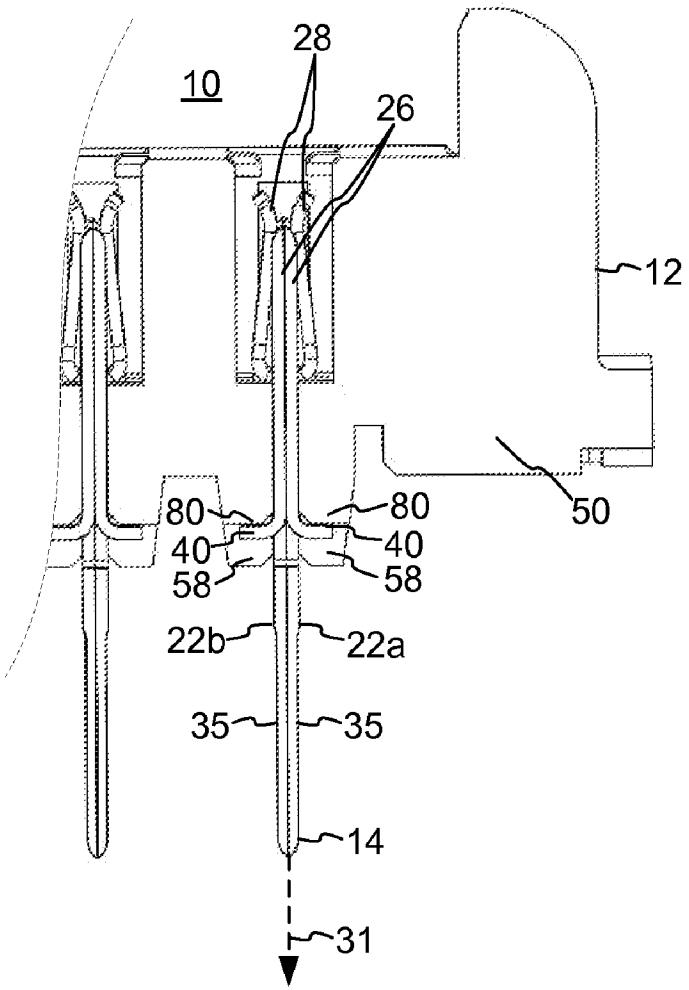
FIG. 15 depicts a cross-sectional top view taken through the line "C-C" of FIG. 2.

Each of the contact beams 34*a*, 34*b* may define an area 35 of reduced thickness (as shown in FIG. 15), to accommodate mating with a receptacle, such as a faston receptacle for example. In particular, the standard thickness of a male faston blade may be approximately 0.032 inch. The nominal thickness of the material from which the first and second halves 22*a*, 22*b* are formed may be approximately 0.020 inch. The reduced thickness area of each beam 34*a*, 34*b* may have a thickness of approximately 0.016 inch, so that the combined thickness of the reduced thickness areas 35 of the first and second halves 22*a*, 22*b* is approximately 0.032 inch.

The reduced-thickness areas 35 on each beam 34*a*, 34*b* may correspond to the portion of the beam 34*a*, 34*b* that contacts the faston receptacle. The outwardly-facing surfaces of the reduced thickness areas 35 may be substantially planar and may be substantially parallel to each other. Being substantially planar and substantially parallel may reduce the potential for an unbalanced or otherwise inadequate connection between the power contact 14 and the mating connector.

Each of the first and second halves 22*a*, 22*b* may include one or more protrusions to help secure the contact 14 within the housing 12. For example, the contact 14 may have a first protrusion that prevents the contact 14 from moving in a first direction 31 relative to the housing 12. The contact 14 may have a second protrusion that prevents the contact from moving relative to the housing 12 in a second direction that is opposite the first direction 31. The second direction may correspond to the direction in which the contact 14 is inserted into the housing 12.

The first protrusion may include a latch 32. The latch 32 may adjoin a respective body portion 24*a*, 24*b* of the corresponding first or second half 22*a*, 22*b*. The latch 32 may be angled in relation to the corresponding body portion 24*a*, 24*b*, as shown in FIG. 6. The latch 32 may extend generally outward from the corresponding body portion 24*a*, 24*b*. Two latches 32 may be used in combination, such that each latch 32 extends from a respective body portion 24*a*, 24*b*. Two sets of latches 32 may be used, such that each set of latches 32 is disposed on either side of the body portions 24*a*, 24*b*. The use of two sets of latches 32 is described for illustrative purposes only. Alternative embodiments can be configured with more, or less than two of the latches 32.

The second protrusion may be a tab 40. Each of the first and second halves 22*a*, 22*b* may include the tab 40. The tab 40 may be formed in the corresponding body portion 24*a*, 24*b* of the first or second half 22*a*, 22*b*. The tabs 40 may each extend in a direction substantially perpendicular to the major surface of the respective body portion 24*a*, 24*b*.

To illustrate, when the contact 14 is inserted into the housing 12, the tab 40 may prevent the contact 14 from moving further into the housing 12 and the latches 32 may engage the housing 12, preventing the contact 14 from moving back out of the housing 12. A third protrusion may be another latch 32, such that there are latches 32 at both sides of the body portion 24*a*, 24*b* with the tab 40 in between, relative to a direction perpendicular to the first direction 31.

The power contact 14 may be configured to receive corresponding contacts at each end. As shown, the power contact 14 may receive a first corresponding contact (not shown) at the contact beam 34*a*, 34*b*. Power contact 14 may received a second corresponding contact (not shown) at the fingers (e.g., angled contact beams 26 and substantially straight contact beams 28). For example, each pair of straight contact beams 28 may be received between a pair of angled contact beams of the second corresponding connector (not shown). Each pair of angled contact beams 26 of the connector 10 may receive a pair of straight contact beams of the second corresponding connector (not shown).

When the power contact is received in the housing 12, the tab 40 may prevent the insertion force of mating the first corresponding contact to deform the arrangement of the fingers. The insertion force of mating the first corresponding contact may tend to cause the fingers to spread apart and for the contact to bow. This deformation may cause less aligned mating between the fingers and the second corresponding contact, which may affect the contact's power transmission performance. The tab 40 may be disposed in-line with the direction of the insertion force. The tab 40 may be disposed substantially centered with respect to the fingers. The tab 40 may be disposed between the fingers and the contact beam 34*a*, 34*b*. The tab 40 may abut the housing and may tend to protect the alignment of the fingers for mating with the second corresponding contact in the presence of insertion force at the first corresponding contact. For example, the fingers may be substantially parallel to one another. The tab 40 may abut the housing under insertion force at the contact beam 34*a*, 34*b* such that the fingers remain substantially parallel to one another.

Figure 7:
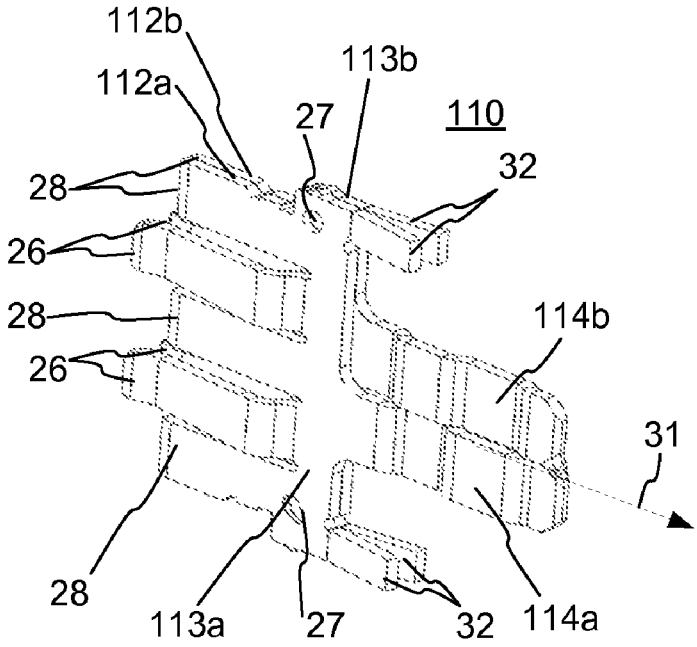

FIG. 7 depicts another power contact 110. Power contact 110 may have a first half 112*a* and a substantially identical second half 112*b*. The power contact 110 may have body portions 113*a*, 113*b* with contact beams 114*a*, 114*b* extending therefrom in a first direction 31 and with fingers (e.g., angled contact beams 26 and substantially straight contact beams 28) extending therefrom in a second direction that is opposite the first direction 31. The contact beams 114*a*, 114*b* may be configured as faston blades. The contact beams 114*a*, 114*b* may be offset from the centerline of the power contact 110 in the vertical direction, so that one of the contact beams 114 is positioned above the other contact beam 114 when the first and second halves 112*a*, 112*b* abut one another. The contact 110 may include one or more projections 27 for alignment. The contact 110 may include one or more latches 32 to help secure the contact 110 when received by a housing 12. Although not depicted in FIG. 7, a tab may be disposed in one or both of the first and second halves 112*a*, 112*b*, like tab 40 as shown in FIG. 6.

Figure 8:
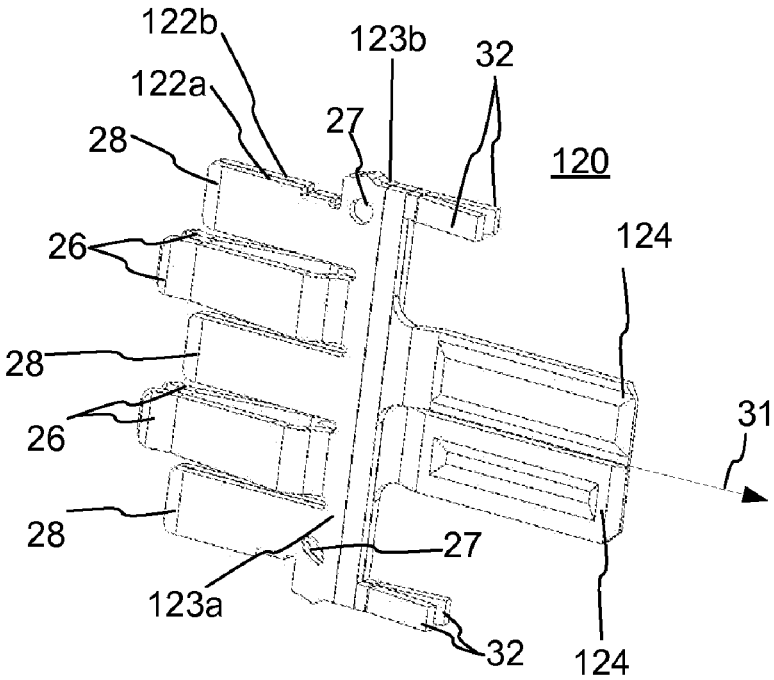

FIG. 8 depicts another power contact 120 having a first half 122*a* and a substantially identical second half 122*b*. The power contact 120 may have body portions 123*a*, 123*b* with contact beams 124*a*, 124*b* extending therefrom in a first direction 31 and with fingers (e.g., angled contact beams 26 and substantially straight contact beams 28) extending therefrom in a second direction that is opposite the first direction 31. The contact beams 124*a*, 124*b* may be configured as faston blades. The contact beams 124*a*, 124*b* may be offset from a centerline of the power contact 120, so that one of the contact beams 124*b* may be positioned above the other contact beam 124*a* when the first and second halves 122*a*, 122*b* abut one another. The contact 120 may include one or more projections 27 for alignment. The contact 120 may include one or more latches 32 to help secure the contact 120 when received by a housing 12. Although not depicted in FIG. 8, a tab may disposed in one or both of the first and second halves 122*a*, 122*b*, like tab 40 as shown in FIG. 6.

Figure 9:
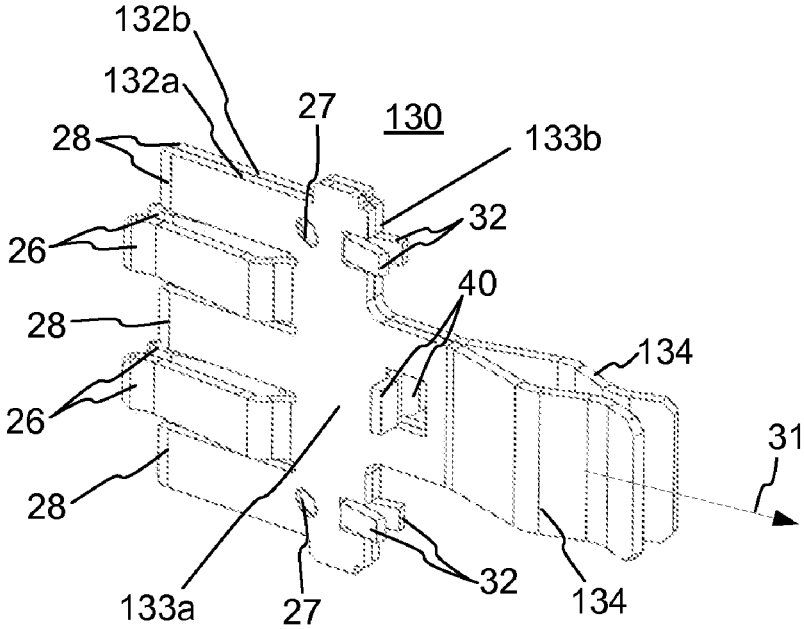

FIG. 9 depicts another a power contact 130 having a first half 132*a* and a substantially identical second half 132*b*. The power contact 130 may have body portions 133*a*, 133*b* with receptacle contact beams 134*a*, 134*b* extending therefrom in a first direction 31 and with fingers (e.g., angled contact beams 26 and substantially straight contact beams 28) extending therefrom in a second direction that is opposite the first direction 31. The receptacle contact beams 134*a*, 134*b* may face each other when the first and second halves 132*a*, 132*b* abut one another. The receptacle contact beams 134 receive the male contact beams of another connector, such as the connector of an AC power cord. The contact 130 may include one or more projections 27 for alignment. To help secure the contact 130 when received in a housing 12, the contact 130 may include one or more latches 32 and one or more tabs 40.

Figure 10A:
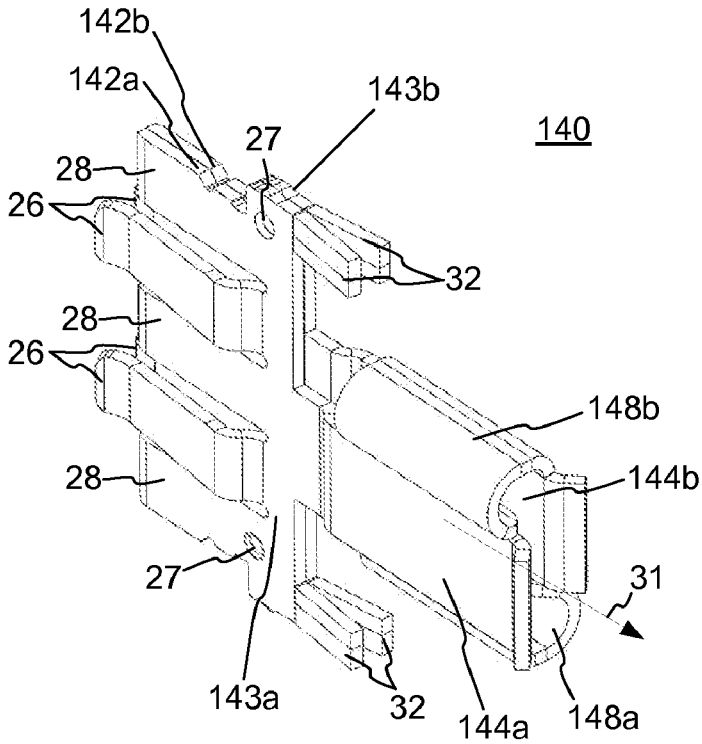
Figure 10B:
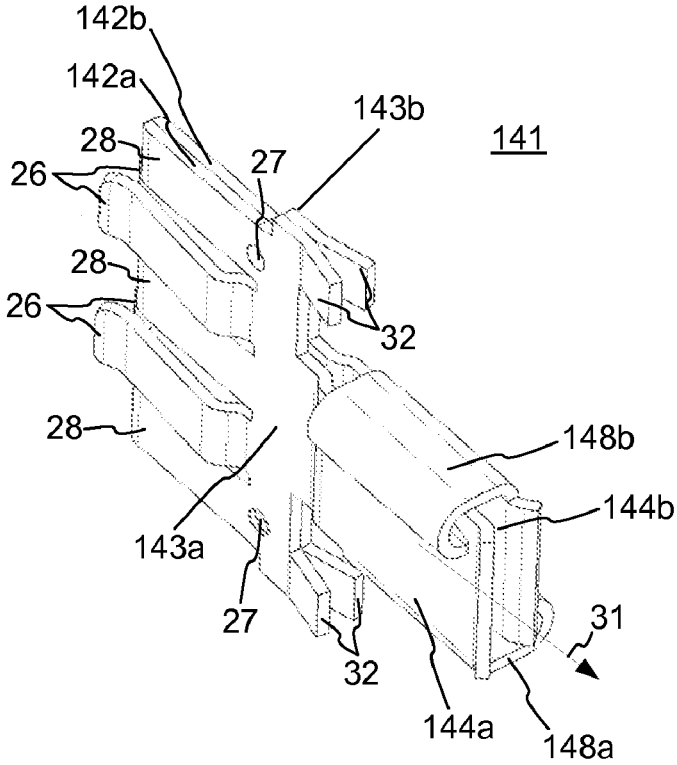
Figure 11:
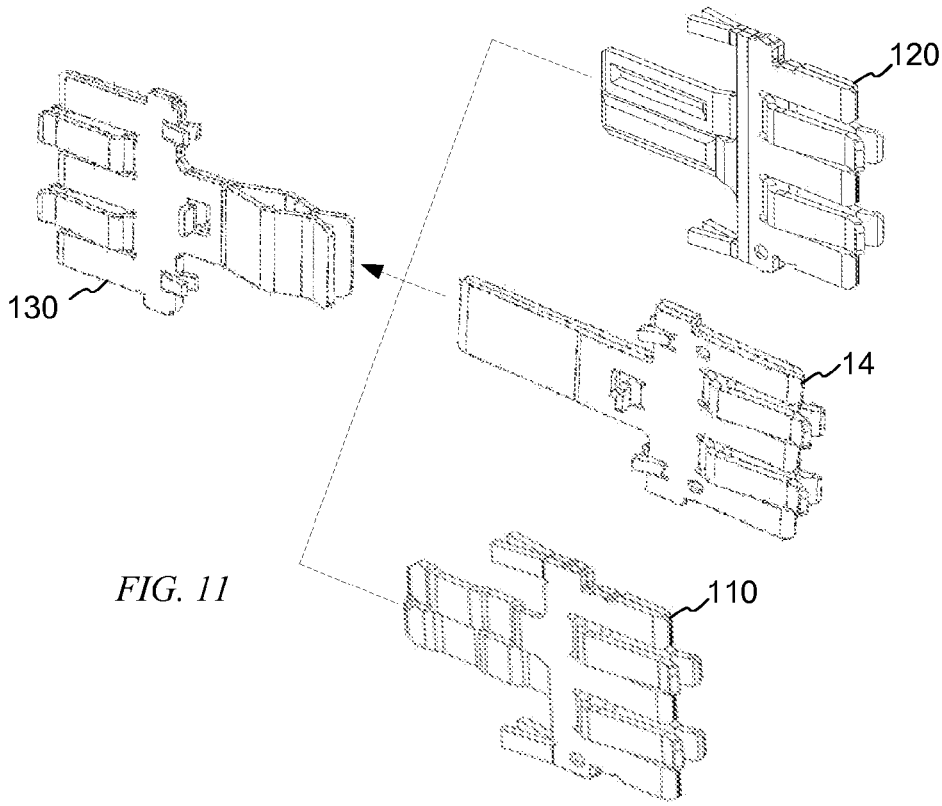
FIGS. 11 and 12 depict example mating compatibilities of example power contacts.

FIGS. 10A and 10B depict example receptacle power contacts 140, 141. The power contacts 140, 141 may be used in an electrical connector 10 and/or power cable assembly. For example, the power contact 140, 141 may be received in a housing, and electrically connected to a cable, such as an AC power cord.

Power contacts 140, 141 may have a first half 142*a* and a substantially identical second half 142*b*. The first and second halves 142*a*, 142*b* each include a respective body portion 143*a*, 143*b* that abut one another. A respective contact beam

144*a*, 144*b* may extend from each body portion 143*a*, 143*b* in a first direction 31. Each respective contact beam 144*a*, 144*b* may be offset from a centerline of the body portion 143*a*, 143*b* from which it extends. The contact beams 144*a*, 144*b* may face each other when the respective body portions 143*a*, 143*b* abut one another. The contact beams 144*a*, 144*b* may be substantially flat.

The power contact 140, 141 may include latches 32. Although not depicted in FIGS. 10A and 10B, a tab may disposed in one or both of the first and second halves 142*a*, 142*b*, like tab 40 as shown in FIG. 6. The latches 32 and tab 40 may be used to help secure the power contact 140, 141 when received in a housing 12.

The receptacle contact beams 144*a*, 144*b* may be configured to receive a male contact blade of a corresponding power contact. The contact surface of the contact beams 144*a*, 144*b* (e.g., the surface of the contact beams 144*a*, 144*b* that contacts the male contact blade of a corresponding electrical contact), may be offset from a vertical plane defined by a surface of the body portion 143*a*, 143*b* from which it extends. For example, the vertical plane may be defined as passing through the center of the power contact 140, 141. The offset may be approximately one-half of the thickness of a corresponding male contact blade. For example, the offset may be approximately 0.016 inch.

With regard to the first half 142*a*, a first clip 148*a* may extend from the first contact beam 144*a*. The clip 148*a* may define a blade receiving area between the first contact beam 144*a* and the second contact beam 144*b*. With regard to the second half 142*b*, a second clip 148*b* may extend from the contact beam 144*b*. The second clip 148*b* may define a blade receiving area between the first contact beam 144*a* and the second contact beam 144*b*. The clips 148*a*, 148*b* may be C-shaped, for example. As shown in FIG. 10A, an edge of the first clip 148*a* may abut the second contact beam 144*b*. Similarly, an edge of the second clip 148*b* may abut the first contact beam 144*a*. As shown in FIG. 10B, an edge of the first clip 148*a* may overlap the second contact beam 144*b*. Similarly, an edge of the second clip 148*b* may overlap the first contact beam 144*a*.

The arrangement of contact beam 144*a*, 144*b* and clip 148*a*, 148*b* may enable the contact beams 144*a*, 144*b* to deflect independently of each other, when mating (i.e., receiving a corresponding male contact beam in the defined blade receiving area). The receptacle contact beams 144*a*, 144*b* may deflect when mated with the corresponding male contact beams. The blade receiving area between each clip 148*a*, 148*b* and the corresponding contacting surface of the male contact blade may act as the initial point of deflection.

Independent deflection may result in independent loading of the receptacle contact beams 144*a*, 144*b*, which may help to ensure that the contact surfaces of the contact beams 144*a*, 144*b* remain substantially parallel to the contact surfaces of the corresponding male contact blade. The independent loading of the receptacle contact beams 144*a*, 144*b* also may help to ensure that the receptacle contact beams 144*a*, 144*b* and the male contact blade remain in a state of equilibrium once mated.

Figure 12:
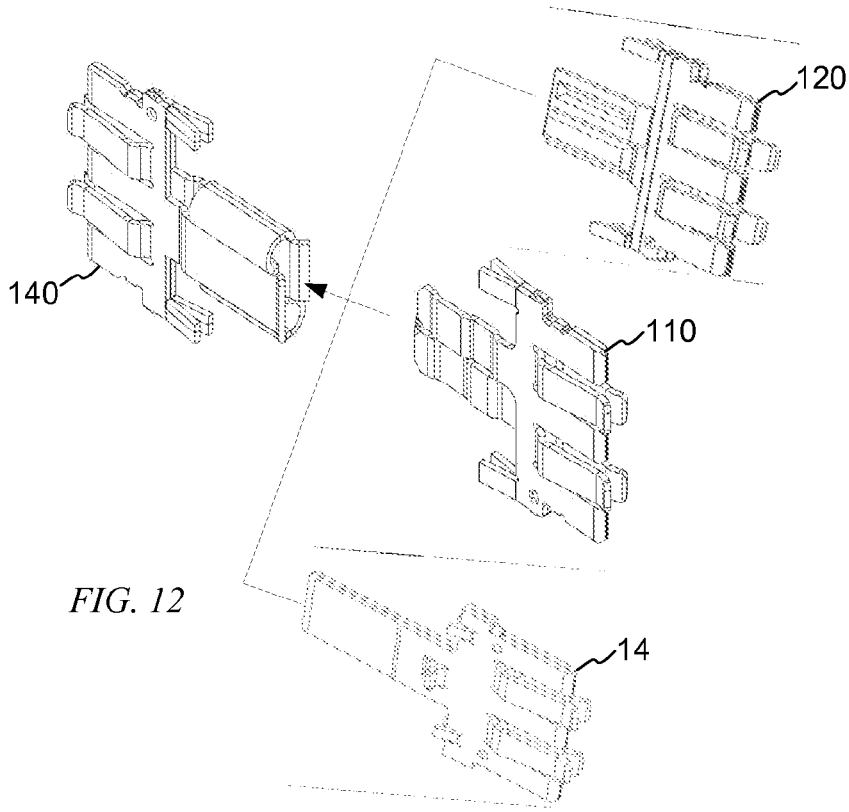

FIGS. 1 and 12 depict an example mating compatibility of the example power contacts. As shown in FIG. 1, contact 130 may mate with the contacts 14, 110, and 120, in applications where such mating is desired. As shown in FIG. 12, contact 140 may mate with the contacts 14, 110, and 120, in applications where such mating is desired. The contacts may be retained in an electrical connector housing. The electrical connector housing may be mounted to a substrate, such as a circuit board for example. The contacts may be electrically connected to a power cable as part of a power cable assembly.

Figure 13:
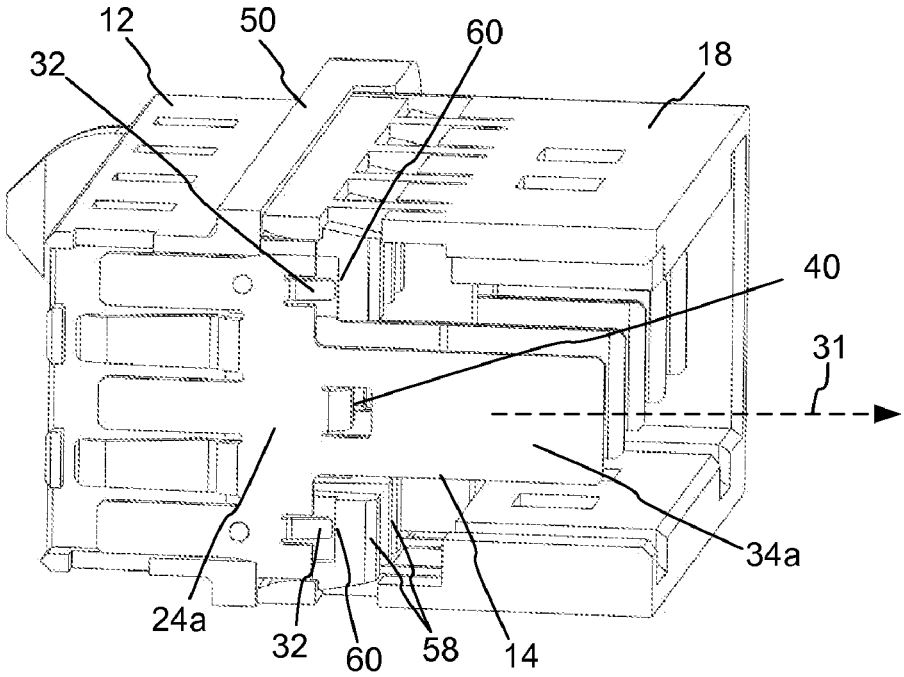
FIGS. 13 and 14 depict a cross-section through the line "B-B" of FIG. 1 in side view and in top rear perspective view, respectively, without the shroud.
Figure 14:
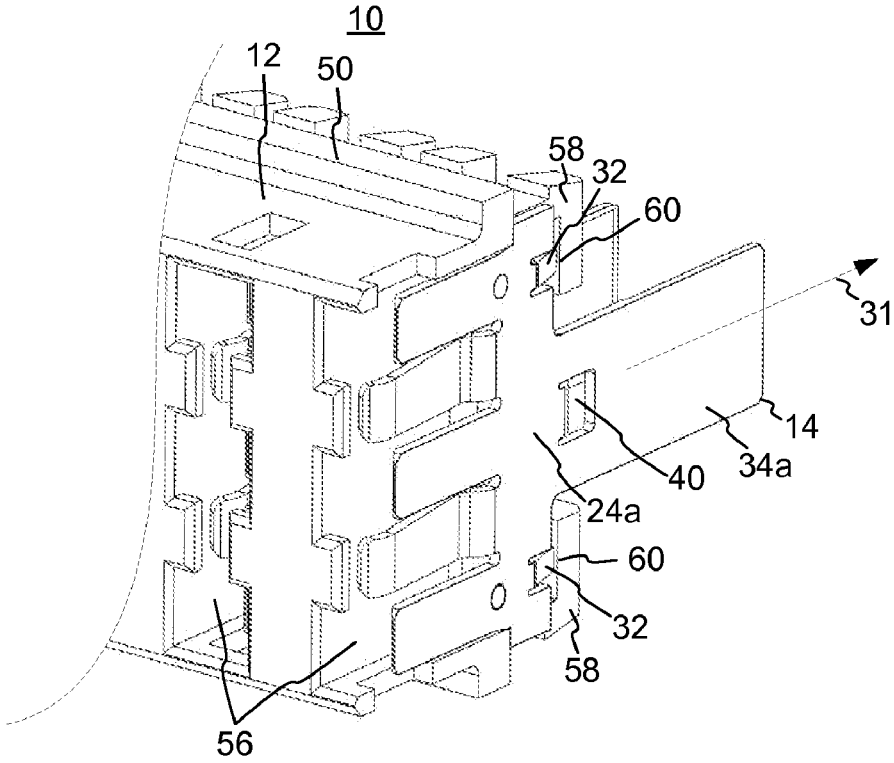
Figure 16:
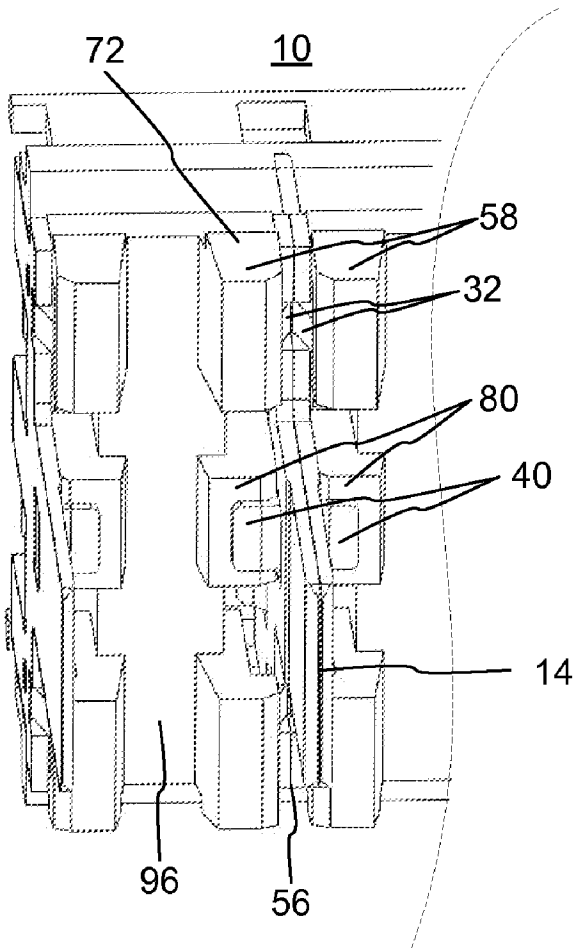
FIG. 16 depicts a top rear perspective view of a portion of the area designated "A" in FIG. 1, without the shroud.

FIGS. 13-16 depict various views illustrating the example power contact 14 received in the housing 12. FIGS. 13-14 depict a cross-section through the line "B-B" of FIG. 1 in side view and in top rear perspective view, respectively, without the shroud 18. FIG. 15 depicts a cross-sectional top view taken through the line "C-C" of FIG. 2. FIG. 16 depicts a top rear perspective view of a portion of the area designated "A" in FIG. 1, without the shroud 18. The housing 12 may define a plurality of projections 58. Between the projections 58, the housing may define corresponding passages 56. The contact 14 may be inserted into the housing 12 and into a passage 56. Each power contact 14 may be retained in a corresponding passage 56. The projections 58 may help to retain the power contacts 14.

As shown in FIGS. 13 and 14, once the contact 14 is received by the passage 56, the projections 58 in cooperation with the latches 32 of the contact 14 may prevent the contact from moving in a first direction 31. The first direction 31 may be defined according to the direction in which the contact beam 34*a*, 34*b* extends from the contact body 24*a*, 24*b*. In particular, the projections 58 may each include a vertically-oriented lip 60 that abuts the latches 32 when the contact 14 is within the passage 56.

As the contact 14 is being inserted into the housing, the angled orientation of the latches 32 may cause the latches 32 to deflect inwardly as they contact the projections 58. The resilience of the latches 32 may cause each latch 32 to spring outwardly, toward its un-deflected position, as it clears the corresponding lip 60. In their un-deflected positions, the latches 32 may abut the corresponding lip 60, preventing the contact 14 from moving in the first direction 31. For example, the latches 32 in cooperation with the projections 58 may prevent the contact 14 from backing out of its corresponding passage 56 when, for example, a corresponding AC power cable assembly is demated from the electrical connector 10 (i.e., pulled away from the connector 10 in the first direction 31).

As shown in FIGS. 15 and 16, the housing 12 may includes a plurality of stops 80. The stops 80 may project from the rearward side of the middle portion 50. The stops 80 may be located between the upper and lower rows of the projections 58.

The contact 14 may be inserted into the housing 12. A stop 80 may correspond with a tab 40 on the power contact 14. The stop 80 may, in cooperation with the tab 40 of the contact 14, prevent the contact from moving in a second direction that is opposite the first direction 31.

As the contact 14 is inserted into the housing, interference between the tab 40 and the associated stop 80 may prevent movement of the power contact 14 further into the housing. The stops 80 and the projections 58, by providing retention for the contacts 14, may obviate the need for structure in addition the housing to retain the contacts 14.

The tab 40 may prevent the fingers (e.g., angled contact beams 26 and substantially straight contact beams 28) from spreading apart when a force in the second direction is applied to the contact 14, such as when a corresponding AC power cable assembly is pushed onto and mated to the electrical connector 10, for example.

Figure 17:
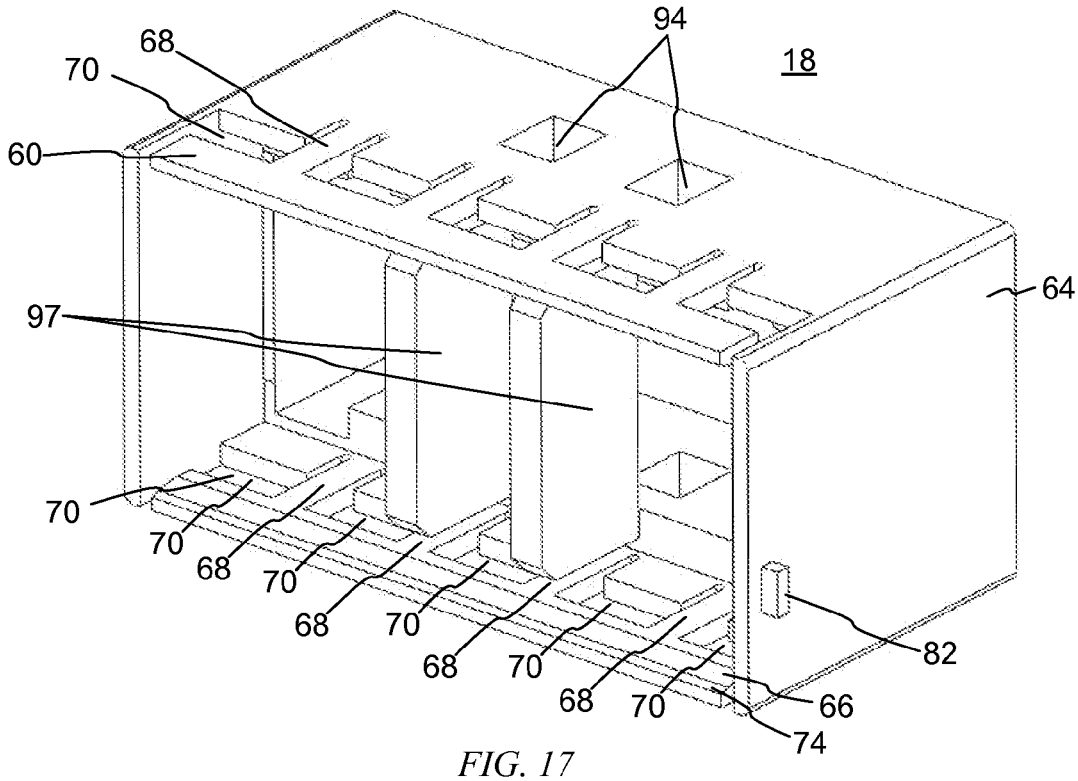
FIGS. 17 and 18 depict an example shroud in top front perspective view and top rear perspective view, respectively.
Figure 18:
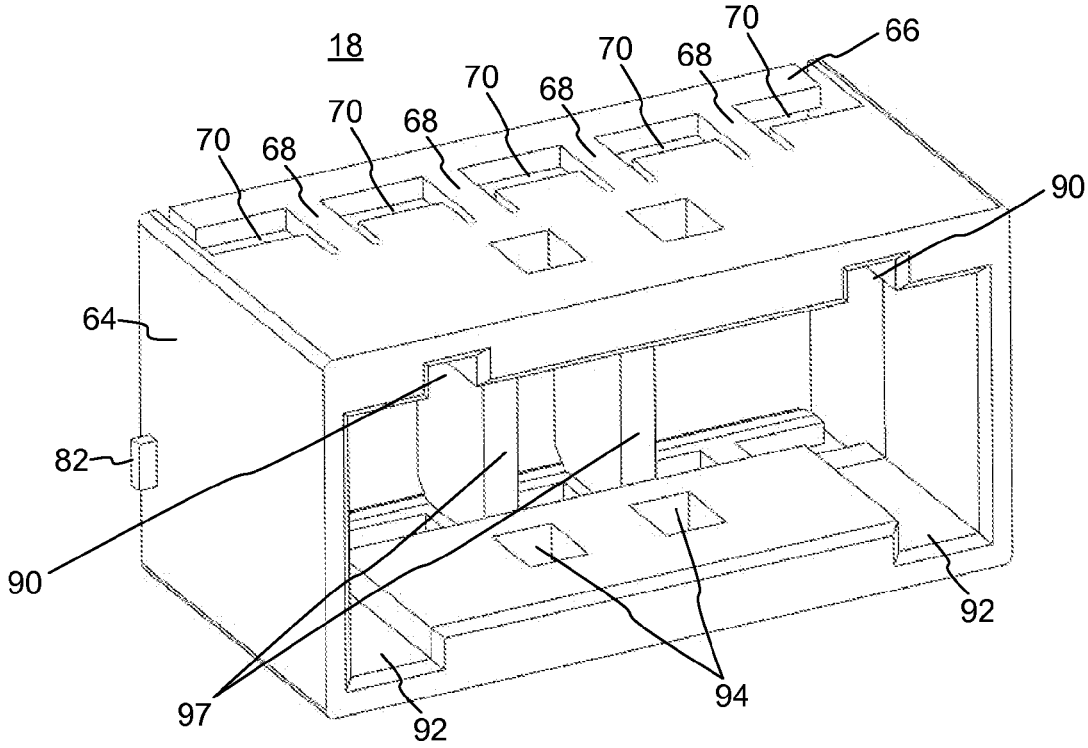
Figure 19:
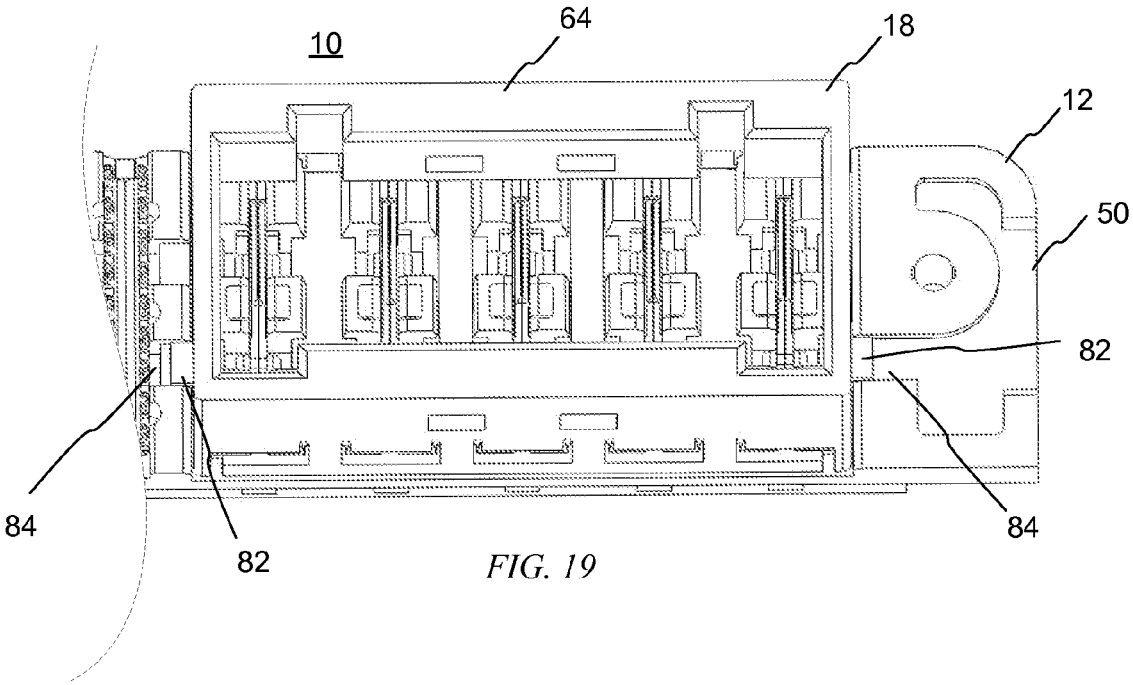
FIG. 19 depicts a rear view of the area designated "A" in FIG. 1.
Figure 20:
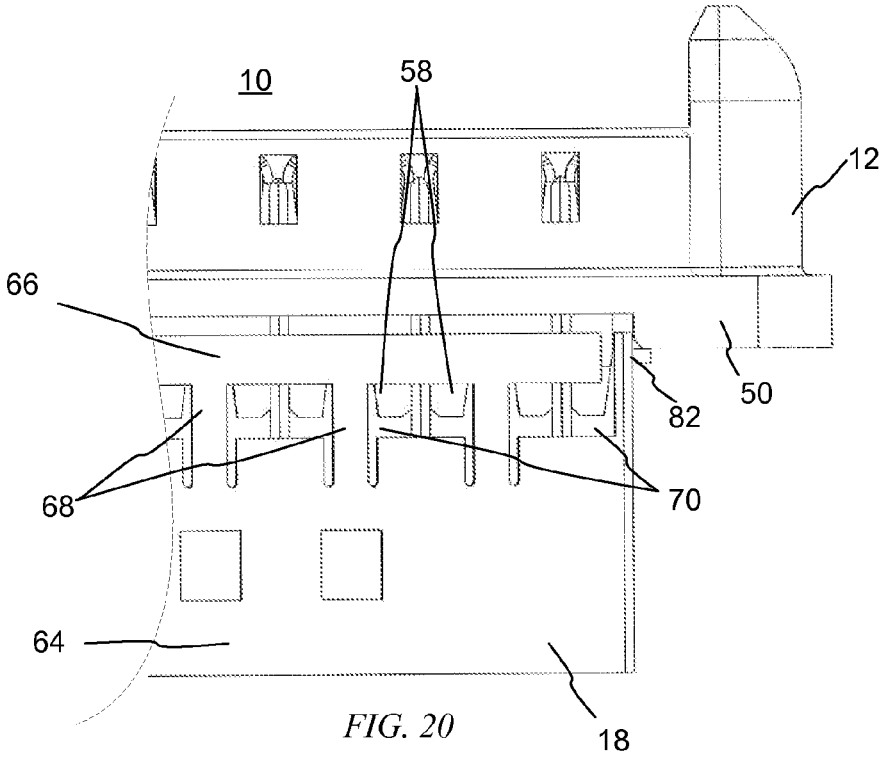
FIG. 20 depicts a top view of a portion of the area designated "A" in FIG. 1, with the shroud of the connector installed on a housing of the connector in an incorrect orientation.

FIGS. 17 and 18 depict an example shroud 18 in top front perspective view and top rear perspective view, respectively. FIG. 19 depicts the shroud 18 retained by the housing 12, illustrating the area designated "A" in FIG. 1. FIG. 20 depicts the shroud 18 installed on the housing 12 in an incorrect orientation.

The shroud 18 may include a body 64 and two latch bars 66 that each may be connected to the body 64 by way of a plurality corresponding of latch arms 68. The body 64, latch bars 66, and latch arms 68 may define one or more openings 70.

The location of the opening 70 may correspond to the location of the projections 58 on the housing 12. As shown in FIGS. 3 and 4, the projections 58 may each include a horizontally-oriented lip 62 at the edge of an upwardly or downwardly-facing angled surface 72.

The shroud 18 may be retained to the housing 12 when an opening 70 receives a corresponding projection 58. When the shroud 18 is received by the housing 12 a ramp 74 of each latch bar 66 may engage the angled surfaces 72 of the corresponding projections 58. Contact between the angled surfaces 72 of the projections 58 and the ramps 74 may cause the latch bars 66 and the latch arms 68 to deflect, until the horizontally-oriented lips 62 at the edge if the angled surfaces 72 clear the latch bars 66. The resilience of the latch arms 68 may cause the latch bars 66 to move toward their un-deflected positions as the horizontally-oriented lips 62 become disposed within the corresponding openings 70. Once retained, the shroud 18 may be covered by a surfaces of a substrate when the connector 10 mounted to further helps to prevent the horizontally-oriented lips 62 from becoming disengaged from the latch bars 66.

While the shroud 18 is being mated to the housing 12, two partitions 97, defined within the body 64 of the shroud 18, may provide alignment. Each partition 97 may be received in a corresponding pocket 96 (i.e., the space defined between adjacent columns of projections 58 on the housing 12 as shown in FIG. 4). Contact between the partitions 97 and the sides of the projections 58 may help to align the shroud 18 with the housing 12 as the shroud 18 and the housing 12 are mated. Moreover, contact between the sides of the body 64 and the two outermost columns of projections 58 further may help to align the shroud 18 and the housing 12 during mating.

The shroud 18 and the housing 12 may include a polarization feature that helps prevent the shroud 18 from being installed incorrectly on the housing 12. In particular, the shroud 18 may include two projections 82. The projections 82 may be formed on opposite sides of the body 64 of the shroud 18. The projections 82 may be located below the center of the shroud 18 (i.e. the projections 82 may be located closer to the bottom of the shroud 18 than the top, as shown in FIGS. 17 and 18) The projections 82 may be located above the center of the shroud 18.

The middle portion 50 of the housing 12 may define two pockets 84 formed in the rearward-facing side thereof. Each pocket 84 may receive a corresponding projection 82 when the shroud 18 is installed correctly on the housing 12. The off-center location of the projections 82 may provide interference between the projections 82 and the middle portion 50 of the housing 12, when an attempt is made to install the shroud 18 incorrectly, e.g., upside down as shown in FIG. 20. This interference prevents the projections 58 of the housing 12 from engaging the latch bars 66 of the shroud 18.

The outermost projection 82, e.g., the projection 82 located on the right side of the housing 12, from the perspective of FIG. 19, may be trapped within the corresponding pocket 84 by a substrate when the connector 10 is mounted on the substrate. The outermost projection 82 thus may acts as a latch that further secures the shroud 18 on the housing 12.

The shroud 18 may include a polarization feature that helps prevent the power contacts 14 and a corresponding AC power cable from being mated incorrectly. In particular, the body 64 of the shroud 18 may define two slots 90 formed in a top portion thereof and may define two slots 92 formed in a bottom portion thereof.

The top slots 90 and the bottom slots 92 may be configured to receive relatively small diameter ribs and relatively large diameter ribs, respectively, on the connector of the AC power cable that mates with the connector 10. Accordingly, the top slots 90 may have a relatively small width, and the bottom slots 92 may have a relatively large width. The spacing between the top slots 90 may be different than that of the bottom slots 92. The noted differences in the spacing and widths of the slots 90, 92 may prevent the connector of the corresponding AC power cable from being installed incorrectly, i.e., upside down. Once the AC power cable is correctly oriented, latches on the connector of the AC power cable may be received in through-holes 94 defined by the body 64 of the shroud 18 to help retain the AC power cable to the shroud 18, and thus, the connector 10.

What is claimed:

1. A power contact configured to be inserted in a connector housing, the power contact, comprising:

first and second abutting body portions, the body portions defining opposing upper and lower ends;

a plurality of fingers extending in a first direction from the body portions, the plurality of fingers including angled contact beams and straight contact beams, wherein the fingers are configured to mate with a complementary power contact;

first and second contact beams each extending from the respective body portions in a second direction opposite the first direction, wherein the first and second contact beams extend from the connector housing when the power contact is inserted in the connector housing, and the first and second contact beams combine to mate with a faston contact; and a projection extending outward from the upper and lower ends of the body portions in a direction angled with respect to the first and second directions, the projection configured to engage a lip of the connector housing so as to prevent the contact from being removed from the connector housing along the second direction.

2. The power contact of claim 1, wherein the first and second contact beams deflect independently of one another during mating of the power receptacle contact with a complementary blade contact.

3. The power contact of claim 1, wherein the first and second contact beams are part of respective contact halves and wherein the contact half associated with the first contact beam is substantially identical to the contact half associated with the second contact beam.

4. The power contact of claim 1, wherein the first contact beam is offset from a center line of the body portion from which the first contact beam extends.

5. The power contact of claim 1, wherein the first contact beam is offset from a vertical plane defined by a surface of the body portion from which the first contact beam extends.

6. The power contact of claim 1, wherein the first and second contact beams are configured to receive a male contact of another connector.

7. The power contact of claim 1, further comprising a clip extending from the first contact beam and defining a blade receiving area between the first and second contact beams.

8. The power contact of claim 7, wherein an edge of the clip overlaps or abuts the second contact beam.

9. The power contact of claim 7, wherein the clip defines a forward surface configured to engage the housing so as to limit insertion of the contact into the housing.

10. A power connector, comprising:

a housing; and a contact received in the housing, wherein the contact comprises first and second planar body portions, first and second contact beams extending in a first direction from the first and second body portions, respectively, a plurality of second contact beams extending from the body portions and through the housing in a second direction that is opposite the first direction, a protrusion extending from the body portion and configured to abut the housing when a first force is applied to the contact in the first direction, and a clip connected between the first and second contact beams, wherein the clip is configured to abut the housing when a second force is applied to the contact in the second direction.

11. The power connector of claim 10, wherein the protrusion is angled outward from the planar body portion.

12. The power connector of claim 10, wherein the contact includes first and second substantially identical abutting halves.

13. The power connector of claim 10, further comprising a shroud received by the housing, wherein the shroud surrounds the contact beam.

14. The power connector of claim 13, wherein the shroud defines a bar that engages a projection of the housing.

15. The power connector of claim 10, wherein the first and second contact beams are configured to receive a male contact of another connector.

16. The power connector of claim 10, further comprising a pair of projections extending from the housing and defining a contact-receiving space therebetween that is configured to receive the plurality of second contact beams, wherein first and second surfaces of at least one of the projections defines first and second respective stop configured to abut the protrusion and the clip, respectively.

17. A power contact configured to be inserted in a connector housing, the power contact, comprising:

first and second abutting body portions, the body portions defining opposing upper and lower ends;

a plurality of fingers extending in a first direction from the body portions, the plurality of fingers configured to mate with a complementary power contact;

first and second contact beams each extending from the respective body portions in a second direction opposite the first direction;

a projection extending outward from the upper and lower ends of the body portions in a direction angled with respect to the first and second directions, the projection configured to engage a lip of the connector housing so as to prevent the contact from being removed from the connector housing along the second direction; and a clip extending from the first contact beam and defining a blade receiving area between the first and second contact beams.

18. The power contact of claim 17, wherein an edge of the clip overlaps or abuts the second contact beam.

19. The power contact of claim 17, wherein the clip defines a forward surface configured to engage the housing so as to limit insertion of the contact into the housing.

20. A power contact configured to be inserted in a connector housing, the power contact, comprising:

first and second abutting body portions, the body portions defining opposing upper and lower ends;

a plurality of fingers extending in a first direction from the body portions, the plurality of fingers configured to mate with a complementary power contact;

first and second contact beams each extending from the respective body portions in a second direction opposite the first direction; and a projection extending outward from the upper and lower ends of the body portions in a direction angled with respect to the first and second directions, the projection configured to engage a lip of the connector housing so as to prevent the contact from being removed from the connector housing along the second direction, wherein the first and second contact beams deflect independently of one another during mating of the power receptacle contact with a complementary blade contact.

21. A power contact configured to be inserted in a connector housing, the power contact, comprising:

first and second abutting body portions, the body portions defining opposing upper and lower ends;

a plurality of fingers extending in a first direction from the body portions, the plurality of fingers configured to mate with a complementary power contact;

first and second contact beams each extending from the respective body portions in a second direction opposite the first direction; and a projection extending outward from the upper and lower ends of the body portions in a direction angled with respect to the first and second directions, the projection configured to engage a lip of the connector housing so as to prevent the contact from being removed from the connector housing along the second direction, wherein the first contact beam is offset from a vertical plane defined by a surface of the body portion from which the first contact beam extends.

22. A power contact configured to be inserted in a connector housing, the power contact, comprising:

first and second abutting body portions, the body portions defining opposing upper and lower ends;

a plurality of fingers extending in a first direction from the body portions, the plurality of fingers configured to mate with a complementary power contact;

first and second contact beams each extending from the respective body portions in a second direction opposite the first direction, wherein the first and second contact beams are configured to receive a male contact of another connector;

a projection extending outward from the upper and lower ends of the body portions in a direction angled with respect to the first and second directions, the projection configured to engage a lip of the connector housing so as to prevent the contact from being removed from the connector housing along the second direction.

* * * * *